US006685603B1

(12) United States Patent
Teeter

(10) Patent No.: US 6,685,603 B1
(45) Date of Patent: Feb. 3, 2004

(54) EXERCISE APPARATUS FOR INVERTING HUMAN BODY

(76) Inventor: Roger C. Teeter, 20720 Snag Island Dr., Sumner Washington, WA (US) 98390

( * ) Notice: Subject to any disclaimer, the term of this patent is extended or adjusted under 35 U.S.C. 154(b) by 0 days.

(21) Appl. No.: 10/350,028

(22) Filed: Jan. 24, 2003

(51) Int. Cl.[7] ..... A63B 26/00; A63B 71/00
(52) U.S. Cl. ..... 482/140; 482/141
(58) Field of Search ..... 482/140, 141, 482/142, 143, 144, 70, 95, 96

(56) References Cited

U.S. PATENT DOCUMENTS 5,203,755 A * 4/1993 Kaiser ..... 482/144

* cited by examiner

*Primary Examiner*—Nicholas D. Lucchesi
*Assistant Examiner*—L Amerson
(74) *Attorney, Agent, or Firm*—Bacon & Thomas, PLLC

(57) ABSTRACT

An exercise apparatus for inverting a human body is disclosed to include a base, two support struts, and a body-inverting mechanism. The two support struts are correspondingly mounted on the base and extend upwardly and slightly forwardly from the base. A connecting strut interconnects top ends of the two support struts. The connecting strut is disposed with a main post at the middle section thereof. The two support struts and the connecting strut together form a U-frame, which leans slightly forwardly toward the base. The body-inverting mechanism includes a seat assembly and a leg engaging assembly and is pivotally mounted on said main post so as to pivot through a limited angle. The U-frame leans slightly forwardly such that a user can do a body rotation exercise forward and backward as well as leftward and rightward with little limitation.

13 Claims, 8 Drawing Sheets

EXERCISE APPARATUS FOR INVERTING HUMAN BODY

BACKGROUND OF THE INVENTION

1. Field of the Invention

The present invention relates generally to exercise equipment, and more particularly to an exercise apparatus for inverting a human body.

2. Description of the Related Art

U.S. Pat. No. 5,203,755 discloses an exercise apparatus for inverting a human body. The exercise apparatus is composed of a base 12, a post 10 extending upwardly and slightly forwardly from the base 12, a rotatable pelvic cushion 30, and two knee cushions 38 and 40. While in operation, a user can stand in front of the pelvic cushion, and bend forwards and downwards transferring his/her weight to the pelvic cushion which rotates clockwise before flexing his/her knees and extending his/her legs partly around the knee cushions to keep his/her body from sliding forwards onto the floor. With the user at this inverted position, a body rotation exercise can be done leftward and rightward without limitation by means of the post, which is single and slightly forward. However, the user cannot do a body exercise forwards and backwards due to the limitation of the post positioned in front of the user while at the inverted position.

SUMMARY OF THE INVENTION

The primary objective of the present invention is to provide an improved exercise apparatus for inverting a human body and the exercise apparatus allows doing a body rotation exercise forward and backward as well as leftward and rightward.

The secondary objective of the present invention is to provide an improved exercise apparatus for inverting a human body and the exercise apparatus is collapsible so as to be compact for storage.

The foregoing objectives of the present invention are attained by the improved exercise apparatus, which is composed of a base, two support struts, and a body-inverting mechanism. The two support struts are correspondingly mounted on the base at bottom ends thereof and extend upwardly and slightly forwardly from the base. A connecting strut, which is positioned between the two support struts, interconnects top ends of the two support struts. The connecting strut is disposed with a main post at the middle section thereof. The two support struts and the connecting strut together form a U-frame, which leans slightly forwardly toward the base. The body-inverting mechanism includes a seat assembly pivotally mounted on a top end of the main post and a leg engaging assembly mounted above the seat assembly. The body-inverting mechanism can pivot about the top end of the main post through a limited angle.

DETAILED DESCRIPTION OF THE INVENTION

Figure 1:
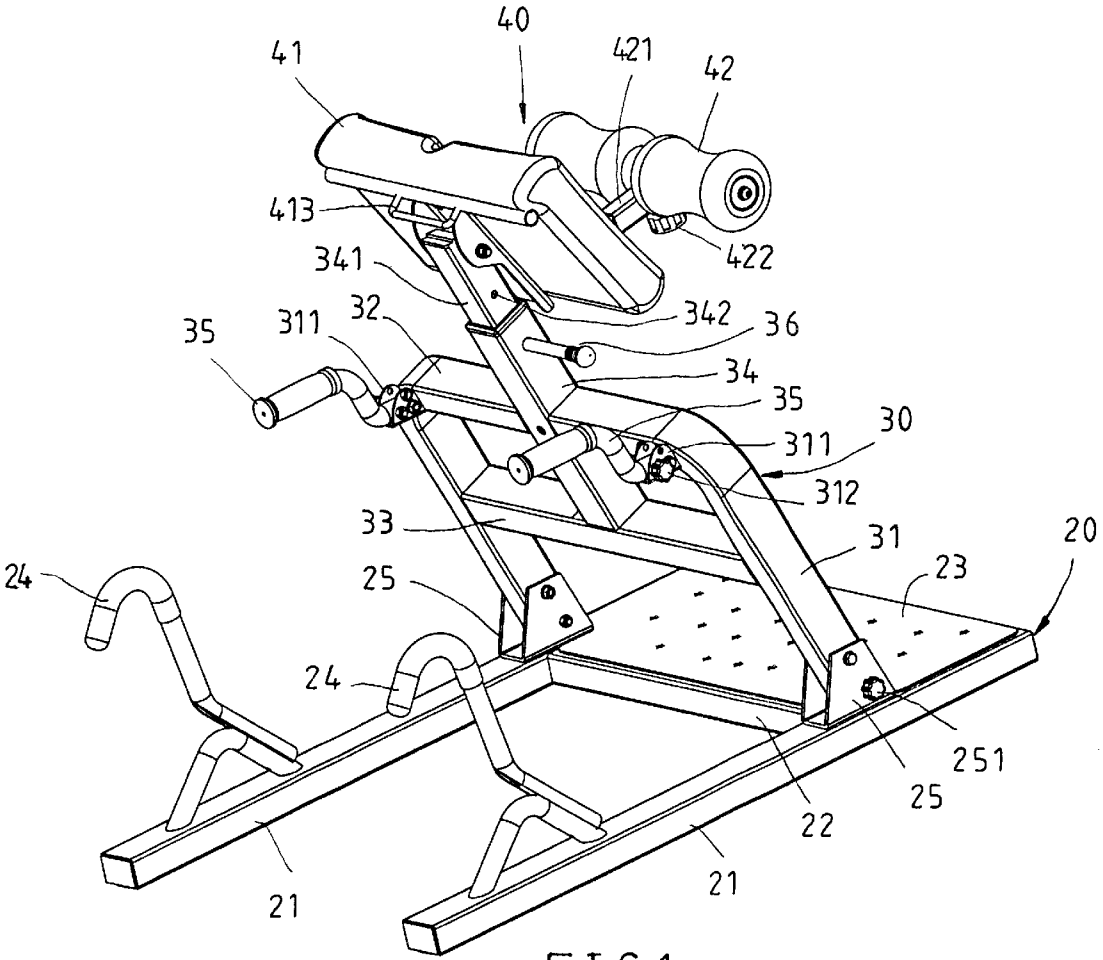
FIG. 1 is a perspective view of a first preferred embodiment of the present invention.
Figure 2:
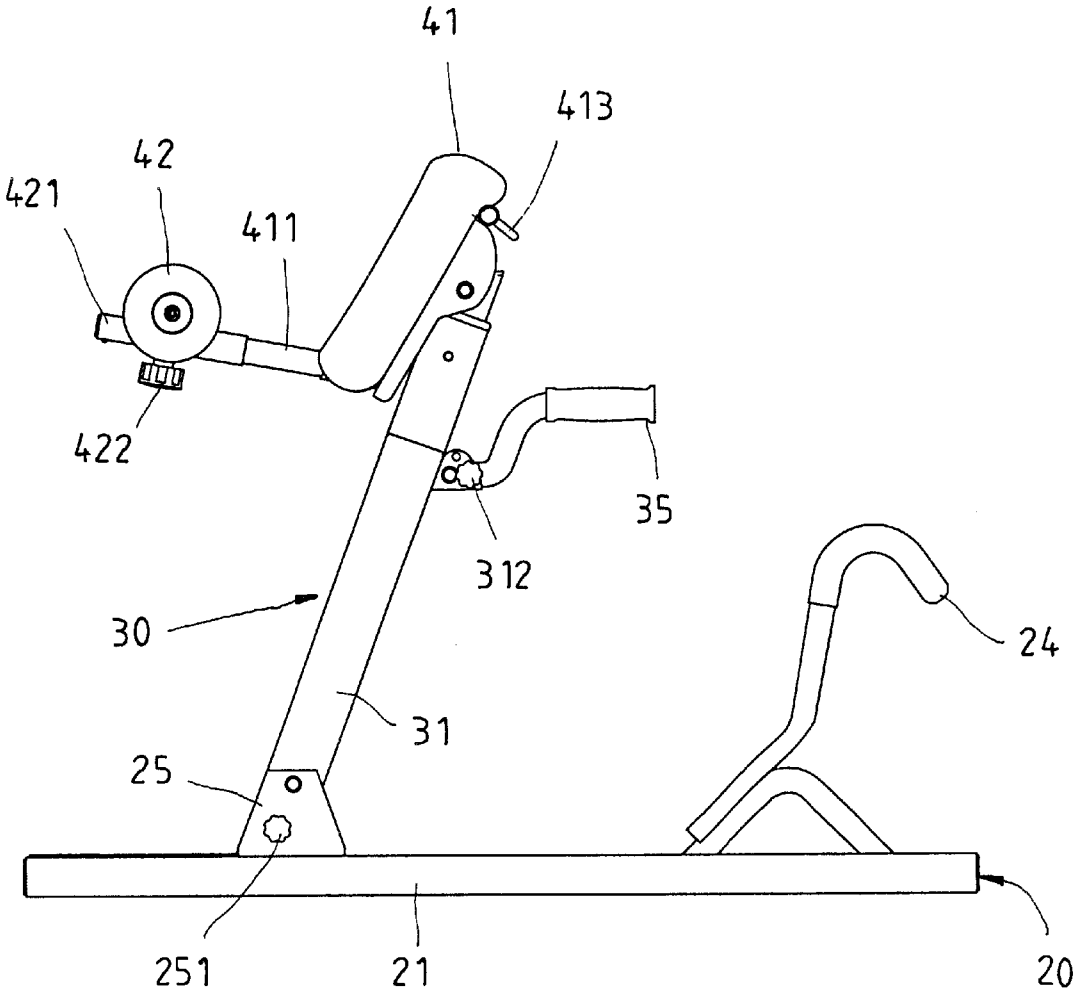
FIG. 2 is a side view of the first preferred embodiment of the present invention.

Referring to FIGS. 1 and 2, an exercise apparatus of a first preferred embodiment of the present invention is composed of a base 20, two support struts 31, and a body-inverting mechanism 40.

The base 20 includes two parallel spaced longitudinal base members 21 and a connecting portion 22 interconnecting the two base members 21. A pedal member 23 is mounted on the connecting portion 22 for a user standing thereon. Each of the base members 21 is disposed with a handgrip 24 at a front side thereof for assisting the user to reach an inverted position and for easily carrying the whole exercise apparatus while the exercise apparatus is at a collapsed position.

The two support struts 31 are respectively mounted on the two base members 21 at two bottom ends thereof and extend upwardly and slightly forwardly. A connecting strut 32 is positioned between and interconnects the two support struts 31 so as to together form a U-frame 30, which leans slightly forwardly toward the base 20. Meanwhile, the U-frame 30 is at an operating position. The U-frame 30 includes a transverse strut 33 mounted between the two support struts 31 and below the connecting strut 32 and a main post 34 mounted at the middle section of the connecting strut 32, wherein the main post 34 has a bottom end mounted on the transverse strut 33.

Figure 3:
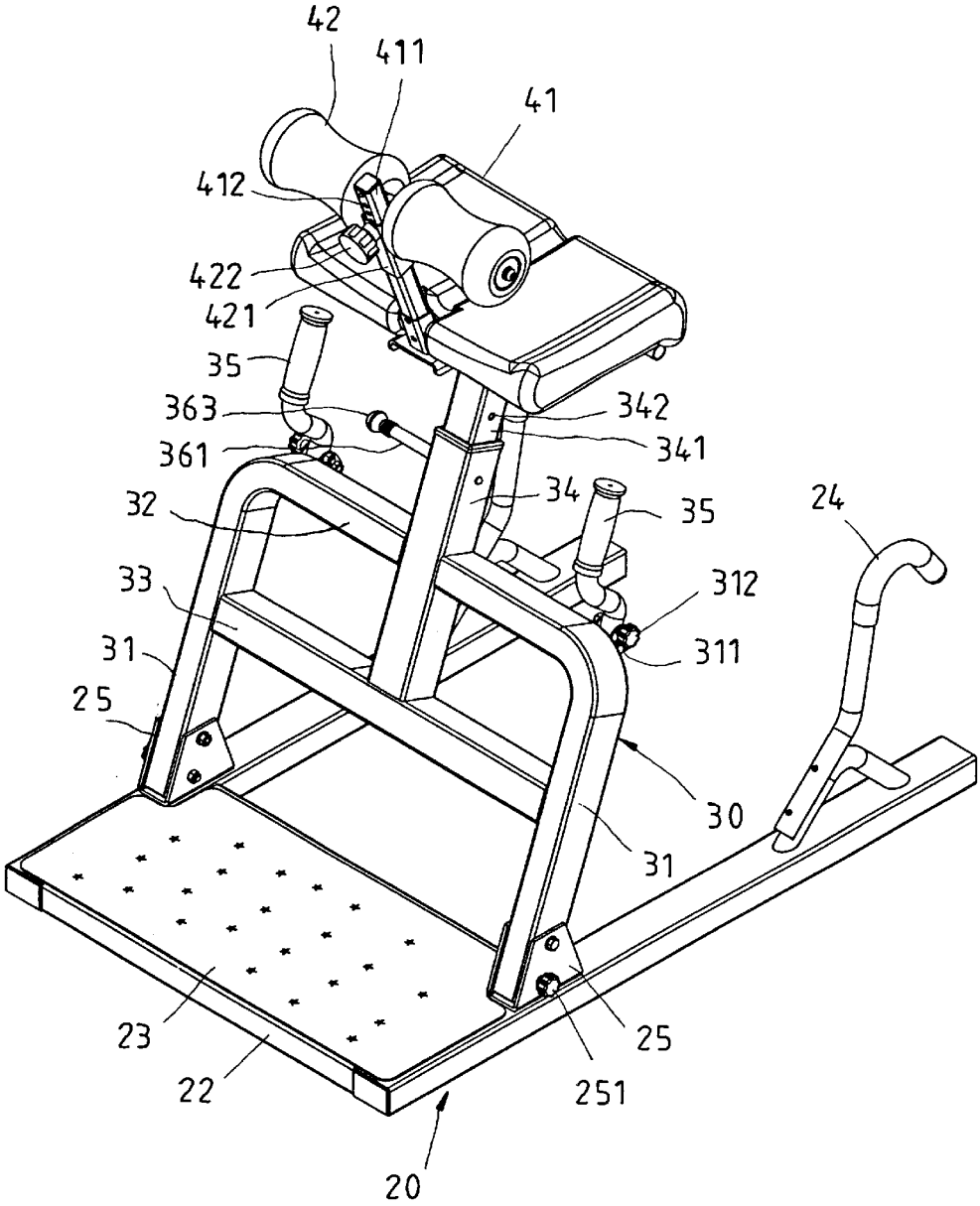
FIG. 3 is a schematic view of the first preferred embodiment of the present invention, showing that a handrail is at a collapsed position.
Figure 4:
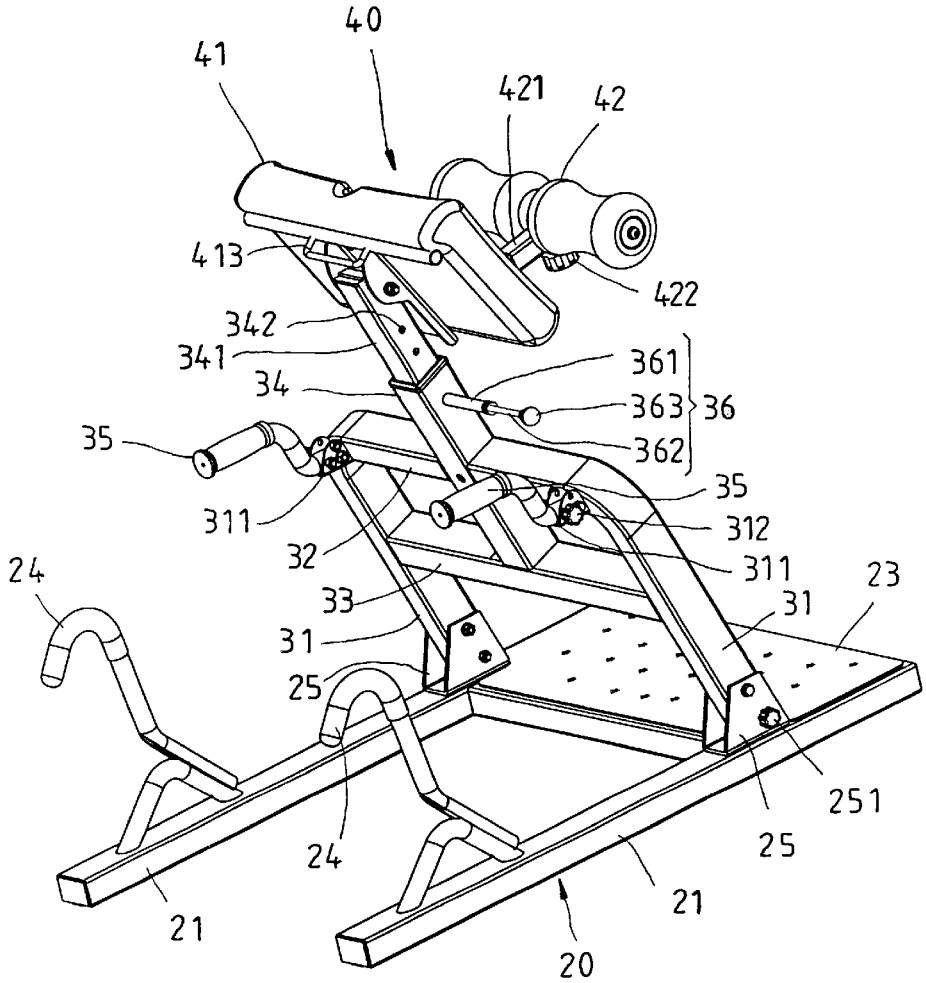
FIG. 4 is a schematic view of the first preferred embodiment of the present invention, showing that a locking unit is at an operating position.

The two base members 21 are disposed with two yokes 25 corresponding to each other on which top sides the two support struts 31 are pivotally mounted. Each of the two yokes 25 is disposed with a first pin 251 at a bottom side thereof. The first pin 251 is detachably mounted on each support strut 31 and is inserted into a bottom end of each support strut 31, thereby fastening the two support struts 31 on the two yokes 25. Referring to FIGS. 1 and 3, each support strut 31 is disposed with a pivot mount 311, a handrail 35 pivotally mounted on the pivot mount 311, and a second pin 312 mounted on the pivot mount 311. Accordingly, the handrails 35 can be turned upward and downward. As shown in FIG. 1, while at an operating position, the handrails 35 are turned downward and then fixed on the pivot mounts 311 by the second pins 312. Likewise, while at a collapsed position, the handrails 35 are turned upward and then fixed on the pivot mounts 311 by the second pin 312.

Referring to FIGS. 1–4, the body-inverting mechanism 40 includes a seat assembly 41 and a leg engaging assembly 42, which are prior arts and will not be described in detail. The main post 34 is fitted with an internal post 341, on which top end the body-inverting mechanism 40 is pivotally mounted. The internal post 341 can move upward and downward with respect to the main post 34 such that the body-inverting mechanism 40 can be adjustably positioned in height. Additionally, the body-inverting mechanism 40 can pivot about the top end of the internal post 341 through a limited angle. While the seat assembly 41 contacts against the top end of the internal post 231 at an underside thereof, the body-inverting mechanism 40 pivots at a maximal angle. The seat assembly 41 is disposed with an arm 411 at a rear side thereof. The leg engaging assembly 42 is disposed with a first sleeve 421 for fitting to the arm 411 such that the leg engaging assembly 42 can move along the arm 411 forward and backward and the distance between the leg engaging assembly 42 and the seat assembly 41 is adjustable. The first sleeve 421 is disposed with an adjustable bolt 422 thereon. The arm 411 is provided with a plurality of first locating holes 412 thereon. The adjustable bolt 422 is inserted into one of the first locating holes 412, thereby mounting the leg engaging assembly 42 on the arm 411 and remaining the distance between the leg engaging assembly 42 and the seat assembly 31. In addition, the seat assembly 41 is disposed with a handlebar 413 at the under side thereof for easily pivoting the body-inverting mechanism 40 by the user.

Furthermore, the main post 34 is disposed with a locking unit 36 at a side thereof. The locking unit 36 includes a second sleeve 361 and a positioning bar 362 fitted in the second sleeve 361. The positioning bar 362 is longer in length than the second sleeve 361. The positioning bar 361 has a gripping portion 363 at an end and is inserted into the main post 34 at the other free end. The internal post 341 is provided with a plurality of pairs of second locating holes 342 at two opposite sides thereof for the free end of the positioning bar 362 inserting therethrough. Accordingly, the internal post 341 is fixed in the main post 34 so as to determine the height of the body-inverting mechanism 40. Additionally, a biasing member (not shown) is mounted between the positioning bar 362 and the second sleeve 361 for pulling the free end of the positioning bar 362 back to inside of the main post 34 while the free end of the positioning bar 362 is pulled away from the pair of second locating holes 342 of the main post 34.

Figure 5:
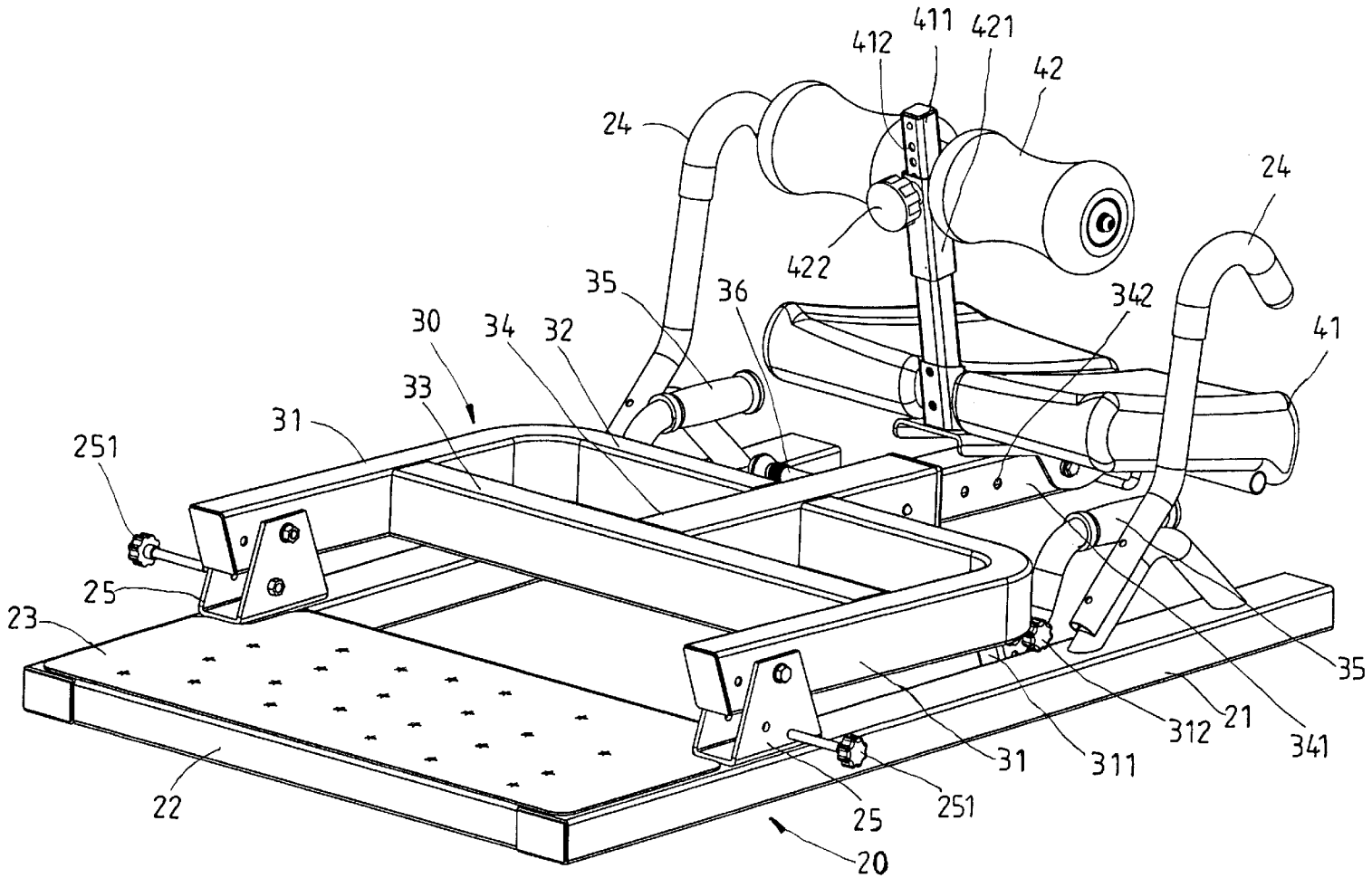
FIG. 5 is a perspective view of the first preferred embodiment of the present invention, showing that a U-frame is at a collapsed position.

Referring FIG. 5, while the exercise apparatus is at the collapsed position, the handrails 35 are at the collapsed position, the first pins 251 are detached from the yokes 25, and then the support struts 31 are collapsed downward such that the U-frame 30 lies against the base members 21. In the meantime, insert the first pins 251 back into the yokes 25 to prevent the U-frame 30 from returning to the operating position. While U-frame 30 and the handrails 35 are respectively fastened by the first pins 251 and the second pins 312, screw nuts fit onto distal ends of the first pins 251 and the second pins 312, thereby respectively mounting the U-frame 30 and the handrails 35 more fixedly on the yokes 25 and the pivot mount 311.

Figure 6:
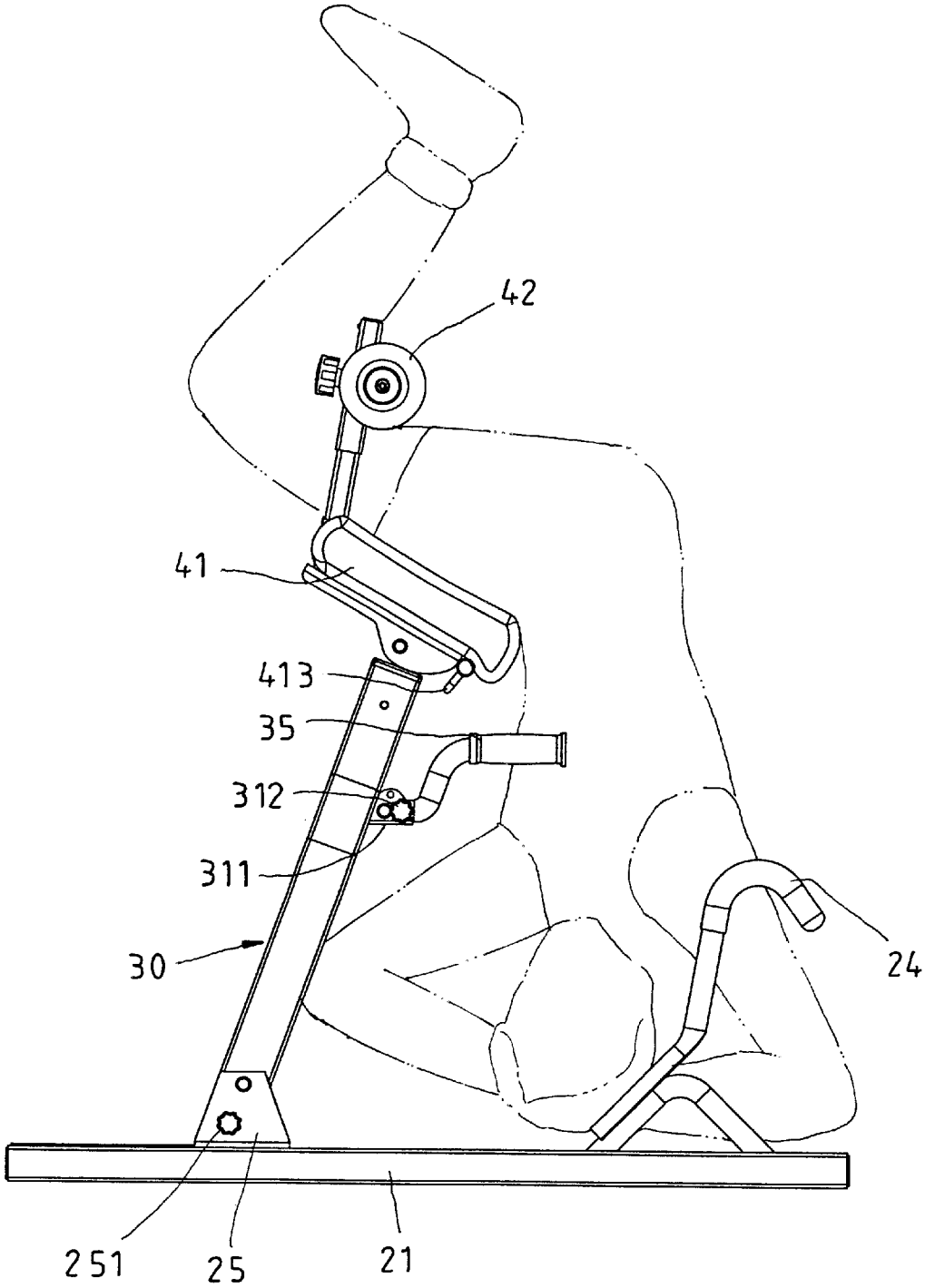
FIG. 6 is a schematic view of the first preferred embodiment of the present invention, showing that a user is doing a body rotation exercise leftward and rightward.
Figure 7:
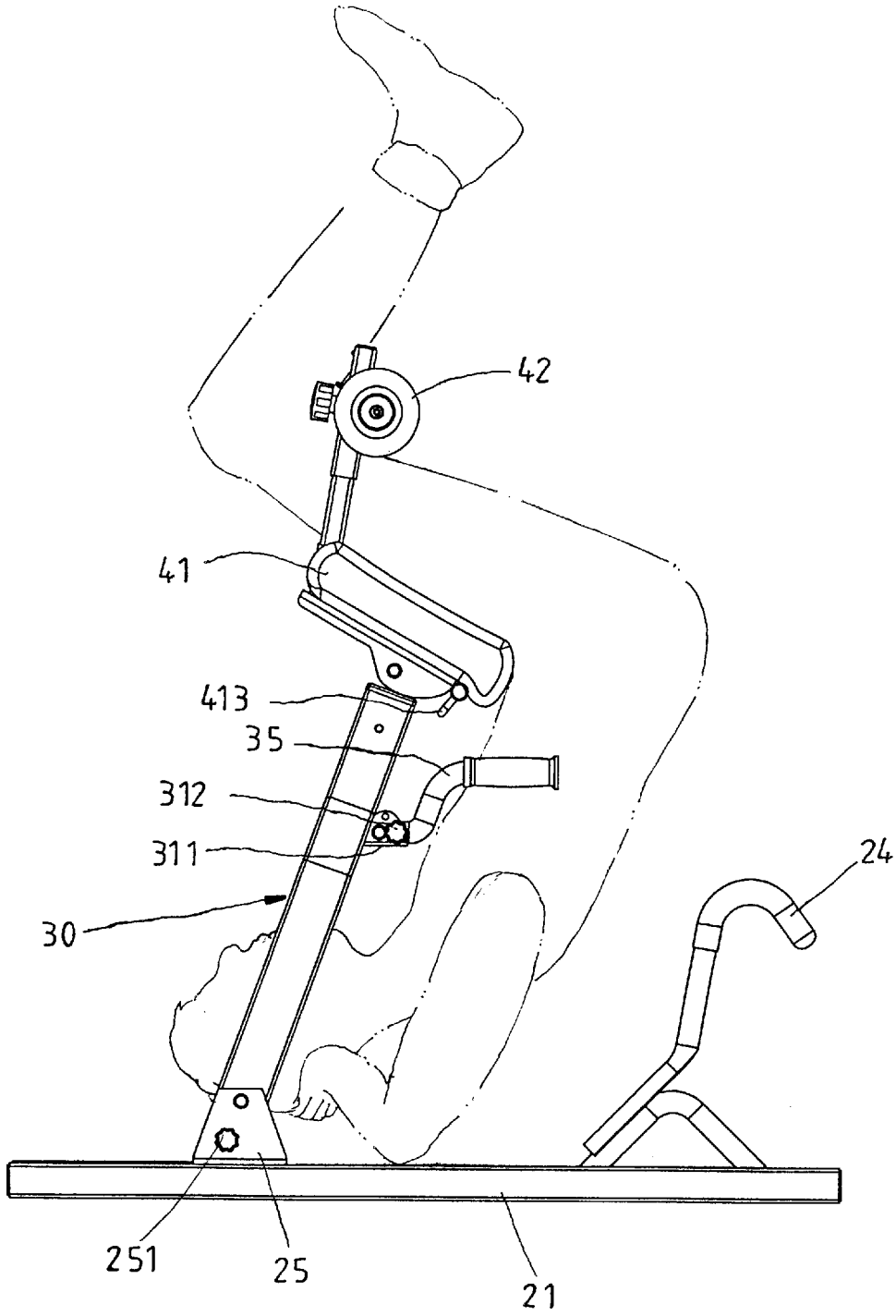
FIG. 7 is a schematic view of the first preferred embodiment of the present invention, showing that the user is doing a body exercise forwards and backwards.

Referring to FIGS. 6 and 7, the user reaches the inverted position by the assistance of the handrails 35. Since the U-frame 30 is positioned slightly forwardly, while the user is at the inverted position, the user can do the body rotation exercise leftward and rightward with little limitation. Additionally, a free space is defined between the transverse strut 33 and the two support struts 31 of the U-frame 30 and is positioned below the transverse strut 33 such that the user can do the body rotation exercise forwards and backwards with little limitation.

Figure 8:
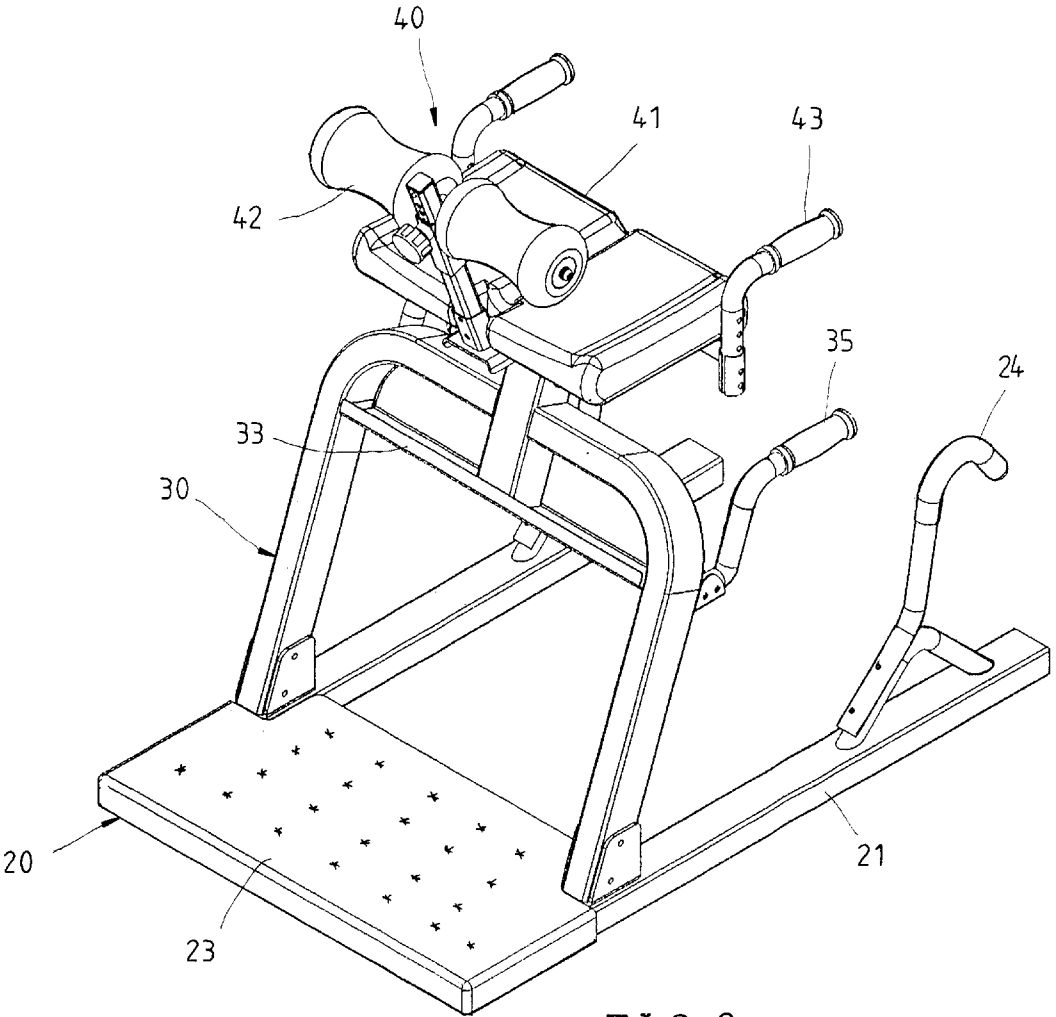
FIG. 8 is a perspective view of a second preferred embodiment of the present invention.

Referring to FIG. 8, the seat assembly 41 of back-inverting mechanism 40 can be additionally adjustably installed with two handles 43 at two sides thereof. The handles 43 are located at such a position that they are inline with the weight centerline of the user while he/she is at the inverted position. The handles 43 are also located vertically so that when the user grasps the handles at the inverted position, his/her arms are 2 to 4 inches short of straight. When the user straightens his/her arms, he/she is able to add substantially to the traction being applied to his/her body by gravity. The double traction of gravity and pushing is especially helpful for people with strong muscles to help them decompress after a workout.

What is claimed is:

1. An exercise apparatus for inverting a human body, said exercise apparatus comprising:

a base;

two support struts mounted on said base at bottom ends thereof and extending upwardly and slightly forwardly from said base, a connecting strut being positioned between said two support struts and interconnecting two top ends of said two support struts so as to together form a U-frame, wherein said connecting strut is disposed with a main post at the middle section thereof, and said U-frame leans slightly forwardly toward said base; and a body-inverting mechanism having a seat assembly and a leg engaging assembly, said seat assembly being pivotally mounted on a top end of said main post and said leg engaging assembly being mounted above said seat assembly such that said body-inverting mechanism can pivot forwards and backwards on the top end of said main post.

2. The exercise apparatus as defined in claim 1, wherein said main post is fitted with an internal post therein, said back-inverting mechanism being pivotally mounted on a top end of said internal post, said internal post traversing along said main post for adjusting the height that said back-inverting mechanism is positioned; wherein said main post is disposed with a locking unit for fastening said internal post to said main post.

3. The exercise apparatus as defined in claim 2, wherein said internal post is provided with a plurality of first locating holes and said locking unit includes a sleeve, a positioning bar fitted in said sleeve, and a gripping portion located at a distal end thereof, said positioning bar being longer in length than said sleeve so as to traverse along said sleeve, said positioning bar being inserted into one of said first locating holes so as to mount said internal post to said main post and secure the height that said back-inverting mechanism is positioned.

4. The exercise apparatus as defined in claim 3, wherein said sleeve of the locking unit and said positioning bar are installed with a biasing member therebetween for providing a rebounding force to pull the other distal end of said positioning bar back into said main post.

5. The exercise apparatus as defined in claim 1, wherein said two support struts are disposed with a transverse strut therebetween for interconnecting said two support struts, and said main post is mounted on said transverse strut at a bottom end thereof.

6. The exercise apparatus as defined in claim 1, wherein said seat assembly is disposed with an arm thereon, and said leg engaging assembly is disposed with a sleeve fitted to said arm so as to traverse along said arm via said sleeve of said leg engaging assembly, said sleeve of the leg engaging assembly being disposed with an adjustable bolt, said arm being provided with a plurality of first locating holes, said sleeve of said leg engaging assembly being fixedly mounted on said arm by inserting said adjustable bolt through one of said first locating holes, whereby the distance between said seat assembly and said leg engaging assembly is fixed.

7. The exercise apparatus as defined in claim 1, wherein said base includes two parallel spaced base members, a connecting portion mounted between and interconnecting said two base members, and two yokes respectively mounted on said two base members; wherein each of said two support struts is mounted on said yoke at a bottom end thereof.

8. The exercise apparatus as defined in claim 7, wherein each said support strut is pivotally mounted on a top side of each said yoke, whereby said U-frame pivots on said two yokes, each said yoke being detachably disposed with a first pin, each said first pin interconnecting each said support strut and each said yoke so as to mount said two support struts fixedly on said two base members.

9. The exercise apparatus as defined in claim 1, wherein each said support strut is pivotally disposed with a handrail at a top front side, each said handrail being turned upwards and downwards to be at an operating position and a collapsed position.

10. The exercise apparatus as defined in claim 1, wherein said base,is disposed with two handgrips at a front side for assisting a user to reach an inverted position and to carry said exercise apparatus.

11. The exercise apparatus as defined in claim 1, wherein said base is disposed with a pedal member at a rear side of said two support struts for a user standing thereon.

12. The exercise apparatus as defined in claim 1, wherein said seat assembly of said body-inverting mechanism is adjustably installed with two handles at two sides thereof, whereby said handles can be adjustably positioned with respect to said seat assembly.

13. The exercise apparatus as defined in claim 12, wherein while a user is at an inverted position, the user can hold said two handles, and meanwhile, said two handles are positioned in alignment with the users' fulcrum.

* * * * *